US009795229B2

(12) United States Patent
Johnson et al.

(10) Patent No.: US 9,795,229 B2
(45) Date of Patent: Oct. 24, 2017

(54) DISPLAY FIXTURE DIVIDER

(71) Applicant: Target Brands, Inc., Minneapolis, MN (US)

(72) Inventors: Jason W. Johnson, Wayzata, MN (US); Erin L. Zobel, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 15/010,097

(22) Filed: Jan. 29, 2016

(65) Prior Publication Data

US 2017/0215603 A1 Aug. 3, 2017

(51) Int. Cl.

| | |
|---|---|
| ***A47F 5/08*** | (2006.01) |
| ***A47F 5/00*** | (2006.01) |
| ***A47F 7/00*** | (2006.01) |
| ***A47F 7/14*** | (2006.01) |

(52) U.S. Cl.

CPC ..... *A47F 5/0056* (2013.01); *A47F 5/0018* (2013.01); *A47F 5/0031* (2013.01); *A47F 5/0087* (2013.01); *A47F 5/0823* (2013.01); *A47F 7/0042* (2013.01); *A47F 7/148* (2013.01)

(58) Field of Classification Search

CPC ..... A47F 5/01; A47F 5/0823; A47F 5/0018; A47F 7/0021; A47F 7/0042; A47F 7/148

See application file for complete search history.

(56) References Cited

U.S. PATENT DOCUMENTS

| | | | | | |
|---|---|---|---|---|---|
| 2,879,899 | A | | 3/1959 | Shenkin | |
| 3,889,813 | A | | 6/1975 | Wright | |
| D242,407 | S | * | 11/1976 | Enckler | D6/566 |
| 4,047,614 | A | * | 9/1977 | Radek | B62H 3/04 211/20 |
| 4,234,094 | A | * | 11/1980 | Jorgensen | A47J 47/16 211/106 |
| 4,342,268 | A | | 8/1982 | Grava | |
| 4,589,935 | A | * | 5/1986 | Scott | C21D 1/10 148/573 |
| 5,111,943 | A | | 5/1992 | Ramey | |
| 5,255,802 | A | * | 10/1993 | Krinke | A47F 5/005 211/184 |
| 5,346,076 | A | | 9/1994 | Hart | |
| 5,380,079 | A | * | 1/1995 | Hamilton | A47B 81/068 211/184 |
| 5,464,105 | A | * | 11/1995 | Mandeltort | A47F 5/005 108/61 |
| 5,743,416 | A | * | 4/1998 | Yemini | B25H 3/04 211/70.6 |

(Continued)

*Primary Examiner* — Leslie A Nicholson, III
*Assistant Examiner* — Kimberley S Wright
(74) *Attorney, Agent, or Firm* — Leanne Taveggia Farrell; Westman, Champlin & Koehler, P.A.

(57) ABSTRACT

A display fixture divider includes a bottom support plate including a main portion having a front edge, a non-linear back edge, a first side and an opposing second side. The non-linear back edge includes a first section that extends backwardly from a back of the first side and intersects with a second section that extends backwardly from a back of the second side. A first wire member includes at least two legs separated by a bend and mounted to the first side of the main portion. A second wire member includes at least two legs separated by a bend and mounted to the second side of the main portion.

18 Claims, 6 Drawing Sheets

(56) References Cited

U.S. PATENT DOCUMENTS 5,836,459 A 11/1998 Nezwek et al.
6,299,001 B1 * 10/2001 Frolov ..... A47F 5/01 211/106
6,883,671 B2 * 4/2005 Rushing ..... A47F 5/005 206/736
8,025,161 B2 9/2011 Chookang
8,042,700 B1 * 10/2011 Smalley ..... A47F 5/0807 211/88.01
8,272,610 B2 * 9/2012 Ernst ..... A47L 13/16 211/106
8,312,998 B2 * 11/2012 Theisen ..... A47F 7/0042 211/128.1
8,636,152 B1 1/2014 Weigand
8,915,381 B2 * 12/2014 Brozak ..... A47F 7/0021 108/61
2002/0088911 A1 * 7/2002 Kao ..... B62J 11/00 248/302
2002/0113183 A1 * 8/2002 Mattesky ..... A47F 5/0823 248/220.41
2005/0194330 A1 * 9/2005 Ziske ..... B25H 3/04 211/59.1
2006/0043032 A1 3/2006 McHugh
2006/0196838 A1 9/2006 Mercure et al.
2007/0045204 A1 3/2007 Huard et al.
2008/0017597 A1 * 1/2008 Branch, III ..... A47F 7/0021 211/44
2009/0107936 A1 * 4/2009 Scriba ..... A47F 5/0807 211/88.01
2011/0062093 A1 * 3/2011 McGhee ..... A47B 43/00 211/50
2012/0305508 A1 * 12/2012 Brozak ..... A47F 7/0021 211/85.5
2014/0001131 A1 * 1/2014 Johnson ..... A47F 5/0025 211/59.2
2014/0032447 A1 1/2014 Fisher
2015/0230629 A1 8/2015 Berry et al.

* cited by examiner

DISPLAY FIXTURE DIVIDER

BACKGROUND

Retail stores use a variety of display fixtures to present products to customers for purchase. These display fixtures can support the product, indicate the product price and include signage for highlighting the product. Exemplary display structures include shelves, trays, racks, peg hooks and other similar structures.

The discussion above is merely provided for general background information and is not intended to be used as an aid in determining the scope of the claimed subject matter.

SUMMARY

A display fixture divider includes a bottom support plate, a first wire member and a second wire member. The bottom support plate includes a main portion having a front edge, a non-linear back edge, a first side and an opposing second side. The non-linear back edge includes a first section that extends backwardly from a back of the first side and intersects with a second section that extends backwardly from a back of the second side. The first wire member includes at least two legs separated by a bend and being mounted to the first side of the main portion. The second wire member includes at least two legs separated by a bend and being mounted to the second side of the main portion.

A display fixture divider includes a bottom support plate including a main portion having a front edge, a back edge, a first side and an opposing second side. A first wire member includes at least two legs separated by a bend. The first wire member has a first end mounted in proximity to the back of the first side of the main portion and a second end mounted in proximity to a front of the first side of the main portion. A second wire member includes at least two legs separated by a bend. The second wire member has a first end mounted in proximity to the back of the second side of the main portion and a second end mounted in proximity to a front of the second side of the main portion. A bracket couples the display fixture divider to a back wall of a gondola. The bracket includes a first arm and a second arm separated by a bend. Each of the first arm and the second arm have at least one through slot.

A method of displaying merchandise includes obtaining a divider comprising a bottom support plate having a front edge, a back edge, a first side and a second side. A first wire member is attached to the first side of the bottom support plate and a second wire member is attached to the second side of the bottom support plate. Determining whether to orient the divider so that the first wire member is closer to an aisle defined by a gondola than the second wire member is to the aisle or to orient the divider so that the second wire member is closer to the aisle than the first wire member is to the aisle based on a direction of foot traffic in the aisle. The divider is mounted to a back wall of the gondola by fastening one of two arms of a bracket that is attached to the first and second wire members. The bracket includes a first arm and a second arm separated from each other by a bend.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

A plurality of multi-configurable dividers or racks are mounted to a back wall of a gondola display unit and are each able to hold at least one product for display, such as a mirror, a frame, artwork or the like. Each divider or rack includes a bottom support plate, a pair of bent wire members that form the shape of a partial triangle and a bracket. Each divider or rack is mounted and oriented at an angle from the back wall of the gondola with the bracket so that a right side of the divider or rack is closer to the back wall that the left side. In the alternative, each rack or divider can be mounted and oriented at an angle from the back wall of the gondola with the same bracket so that a left side of the divider or rack is closer to the back wall than the right side. Depending on the planogram of the store and the flow of foot traffic, the plurality of racks or dividers might be better suited to be oriented so that the right side is closer to the back wall or better suited to be oriented so that the left side is closer to the back wall. No matter, all racks can be mounted in either configuration thus making the racks or dividers versatilely equipped.

Figure 1:
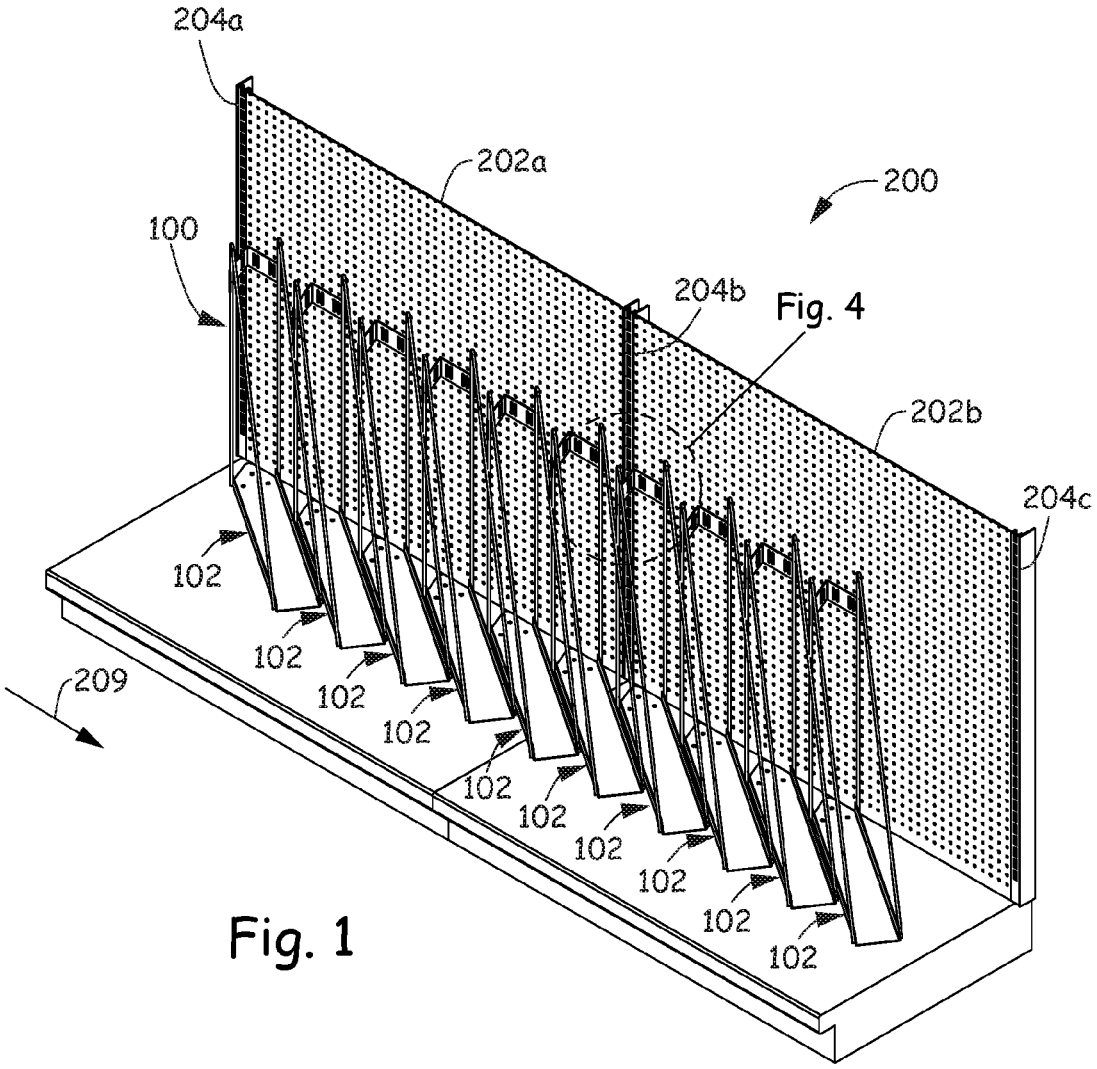
FIG. 1 is a perspective view of a display fixture according to one embodiment.
Figure 2:
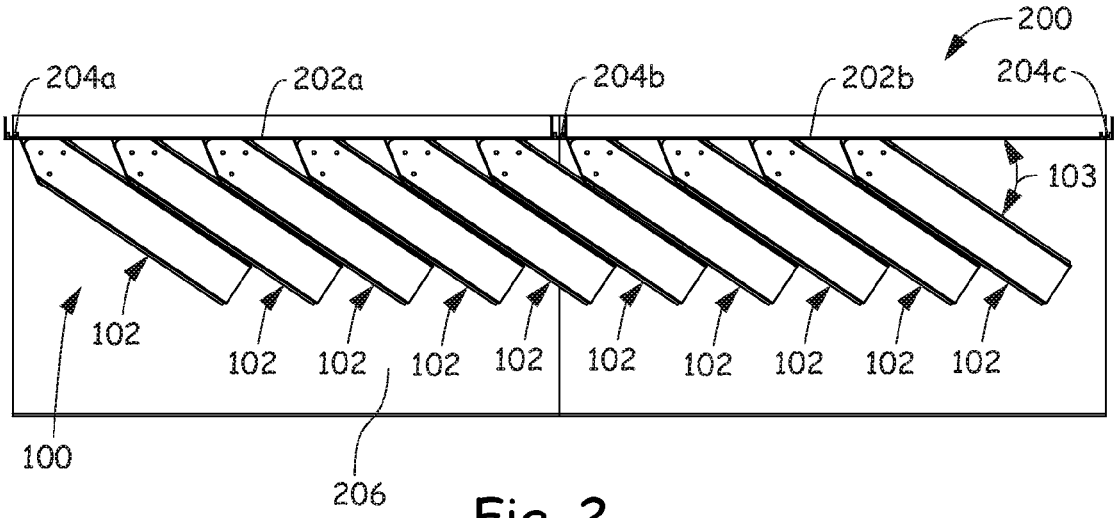
FIG. 2 is a top view of the display fixture illustrated in FIG. 1.
Figure 3:
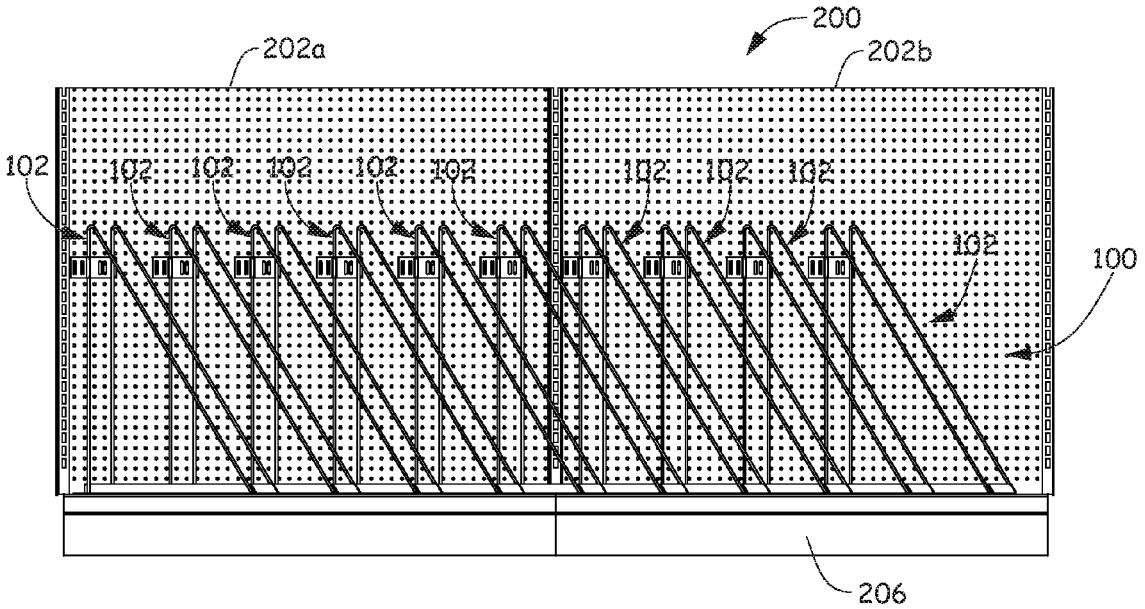
FIG. 3 is a front view of the display fixture illustrated in FIG. 1.
Figure 4:
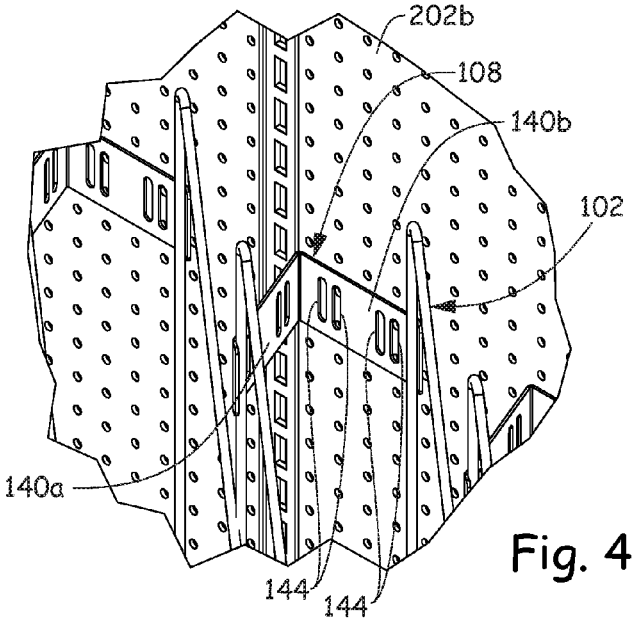
FIG. 4 is an enlarged view of a portion of FIG. 1.

FIG. 1 is a perspective view of a divider display fixture 100 according to one embodiment. FIG. 2 is a top view, FIG. 3 is a front view of divider display fixture 100 and FIG. 4 is an enlarged view of a portion of FIG. 3. Divider display fixture 100 includes a plurality of dividers or racks 102 that are mounted to back walls 202*a* and 202*b* of a gondola 200. A gondola is a freestanding display fixture used to display products and merchandise. Gondolas include flat, substantially horizontal bases or base decks and a substantially vertical back wall supported by a pair of slotted uprights. The substantially vertical back wall can feature notches, pegboards and/or slat walls. In addition, the vertical back wall can be fitted with shelves, peg hooks or other display components. Gondolas placed side-by-side form rows that define aisles. In the embodiment described herein, substantially vertical back walls 202*a* and 202*b* of gondola 200 are supported by slotted uprights 204*a*, 204*b* and 204*c* and extend from base deck 206 and although not illustrated can include shelves spaced above the base deck 206.

Figure 5:
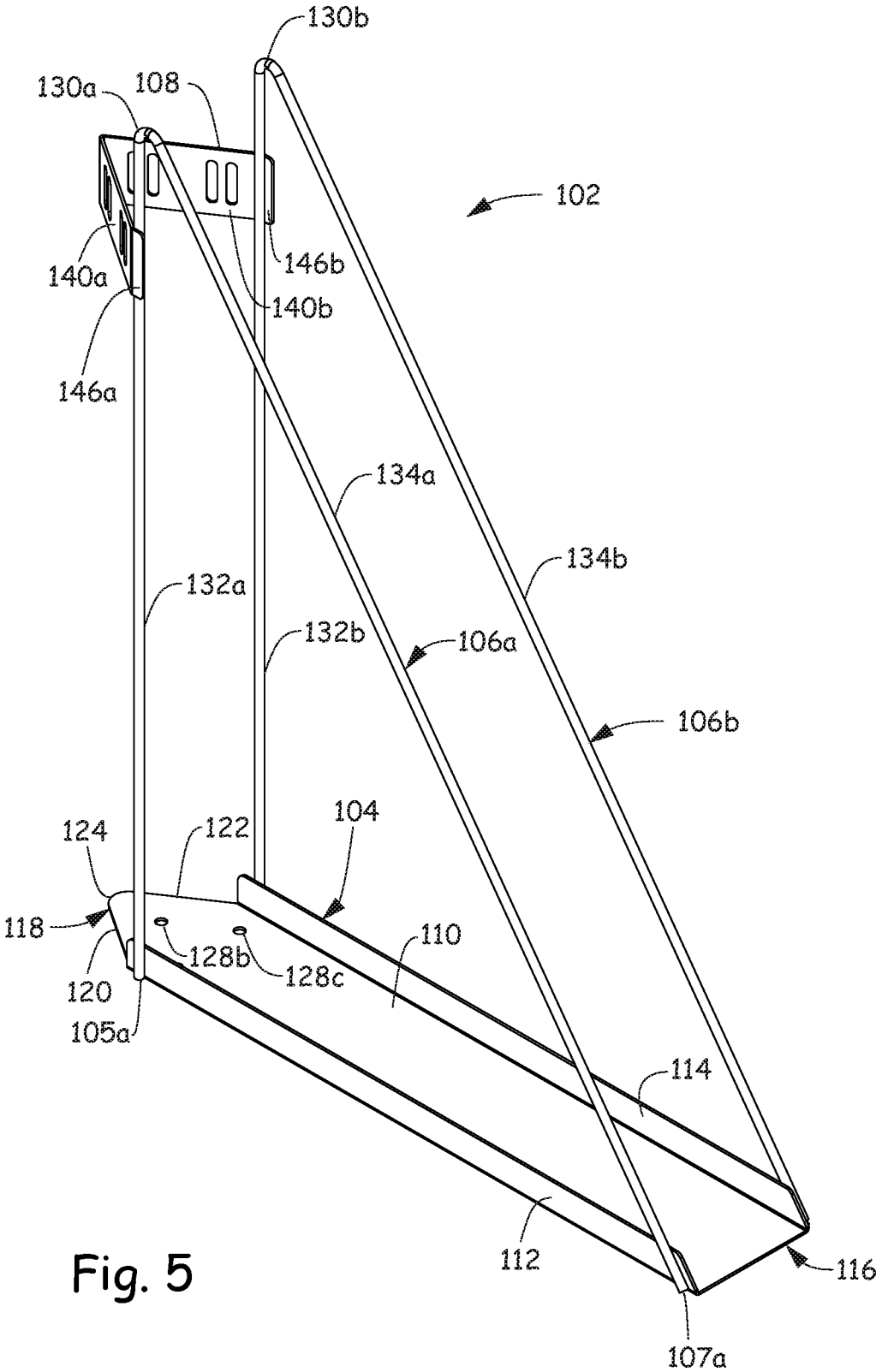
FIG. 5 is a perspective view of one of the dividers of the display fixture illustrated in FIG. 1.
Figure 6:
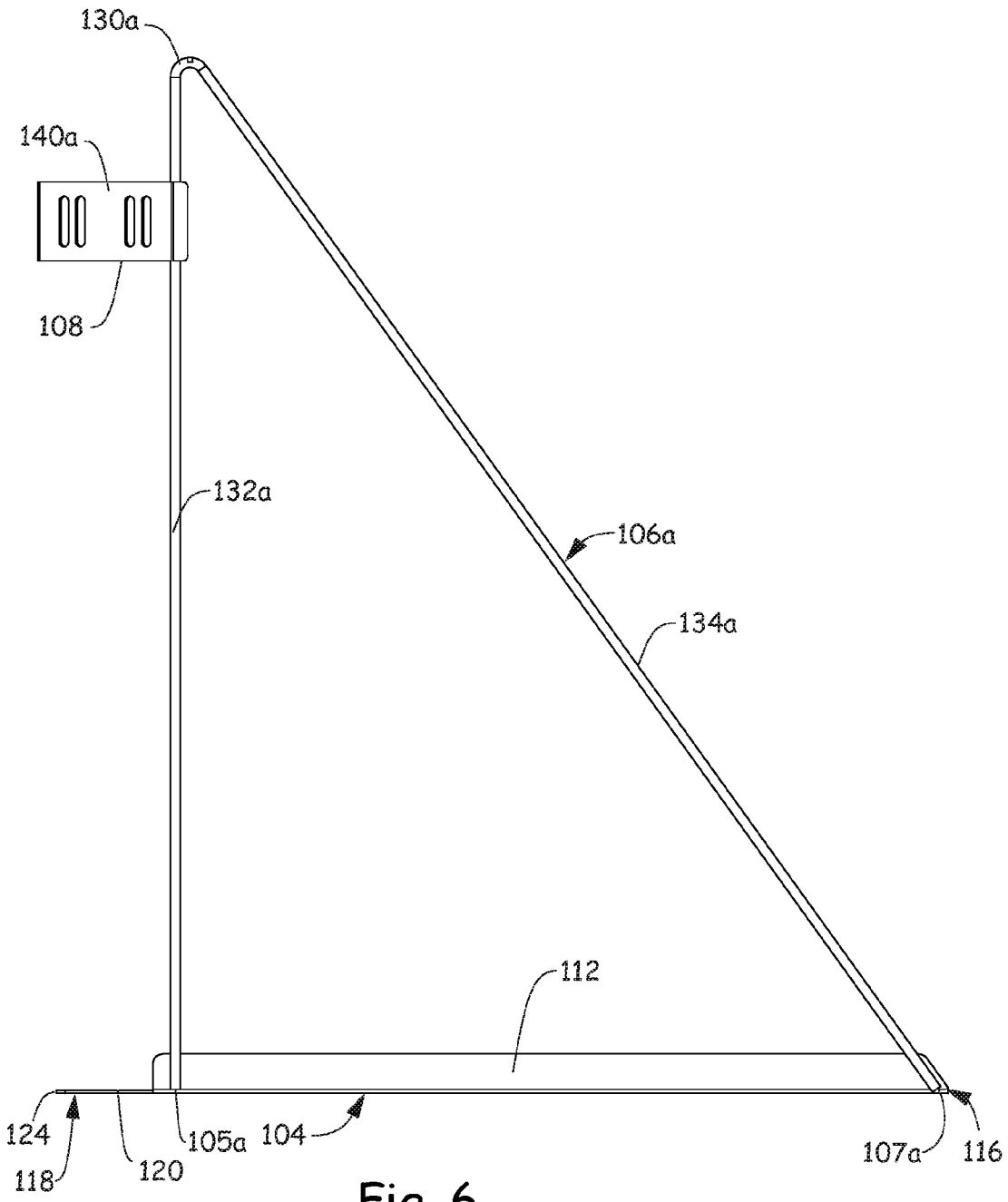
FIG. 6 is a left side view of the divider in FIG. 6.
Figure 7:
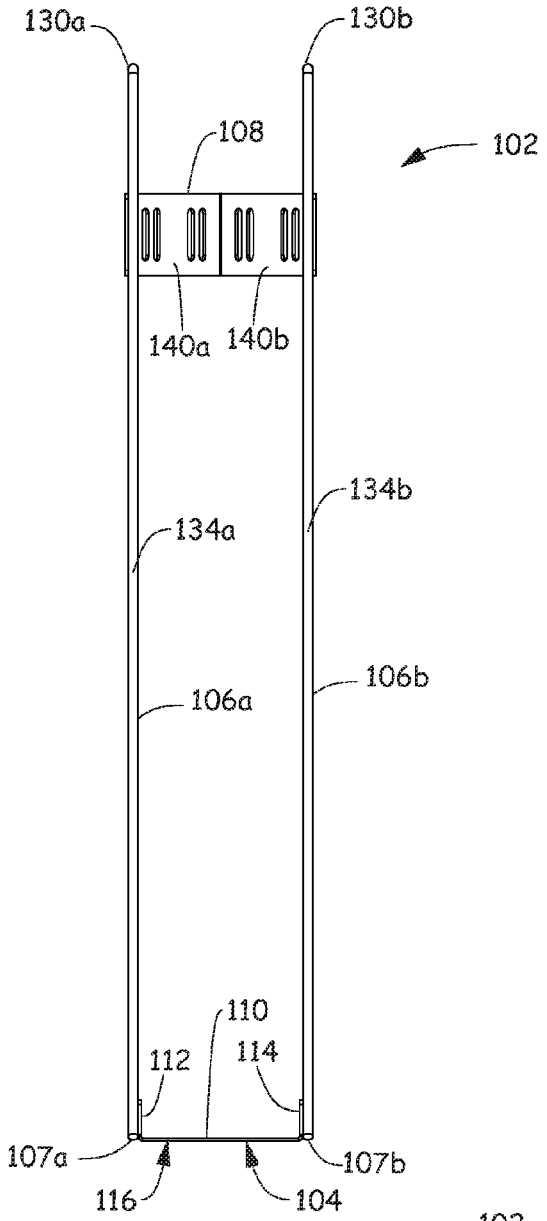
FIG. 7 is a front view of the divider in FIG. 6.
Figure 8:
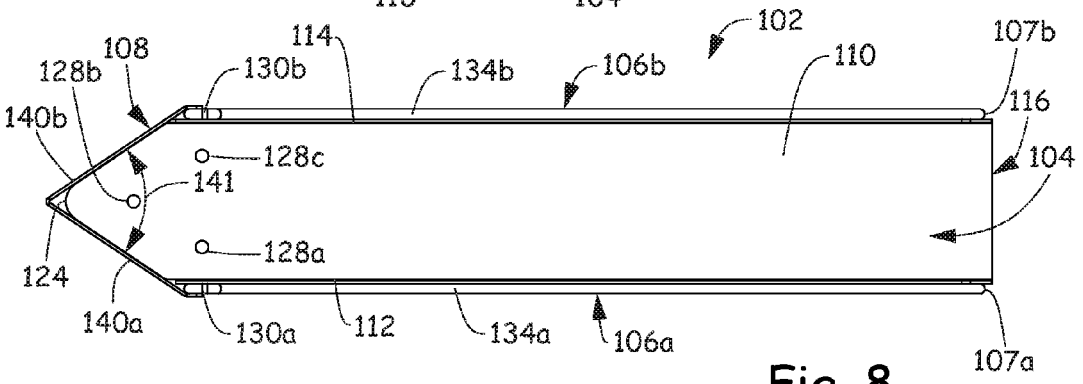
FIG. 8 is a top view of the divider in FIG. 6.

FIG. 5 is a perspective view of one of the dividers 102 of the divider display fixture 100. FIG. 6 is a left side view (the right side being a mirror image), FIG. 7 is a front view, and FIG. 8 is a top view of divider 102. Divider 102 includes a bottom support plate 104, a pair of wire members 106*a* and 106*b* and a bracket 108.

Figure 9:
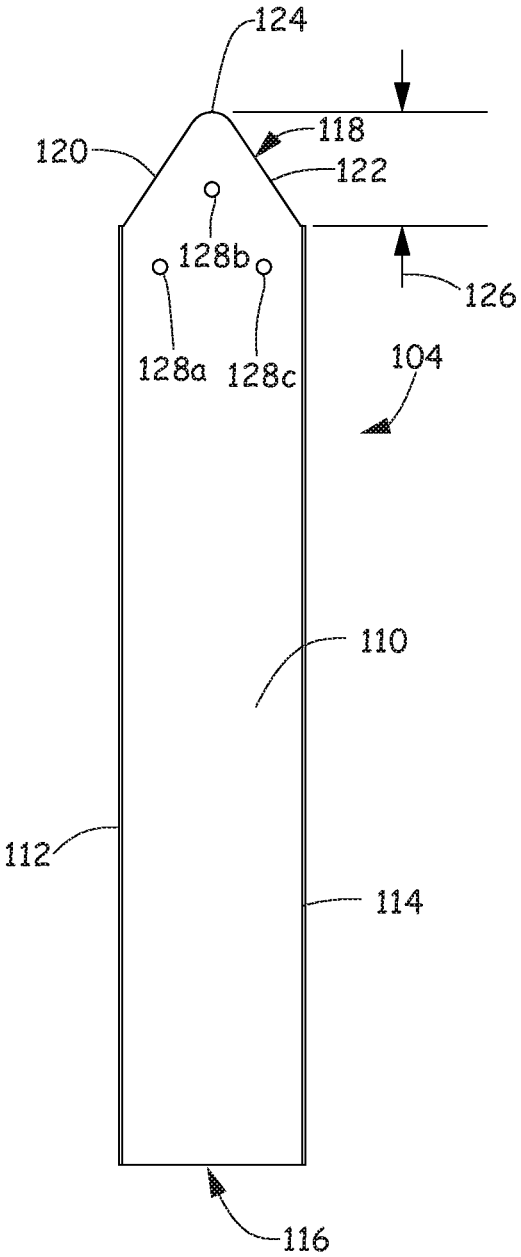
FIG. 9 is a top view of a bottom support plate of the divider illustrated in FIG. 6.

FIG. 9 is a top view of bottom support plate 104 alone. Bottom support plate 104 includes a main portion 110, a first side portion 112 and a second side portion 114. While it is possible that each portion 110, 112 and 114 are separate components that are attached together to form bottom support plate 104, in one embodiment and as illustrated in the figures, bottom support plate 104 is made of a single, continuous piece of material, such as sheet metal and the like. First side portion 112 is bent out-of-plane from a first side of main portion 110 and second side portion 114 is bent out-of-plane from an opposing second side of main portion 110 so that first side portion 112 and second side portion 114 are substantially vertical relative to substantially horizontal main portion 110. In other words, first side portion 112 is located on and defines a left side of main portion 110 and second side portion 114 is located on and defines a right side of main portion 110.

Bottom support plate 104 also includes a front edge 116 and a back edge 118. Front edge 116 is a straight or linear edge that runs from first side portion 112 to second side portion 114 in one embodiment. Back edge 118, however, is a non-linear edge that runs from first side portion 112 to second side portion 114. In particular, back edge 118 includes a first section 120 that extends backwardly from a back of first side portion 112 and intersects with a second section 122 that extends backwardly from a back of second side portion 114 at a point 124. Point 124 is located a distance 126 away from the ends of first side portion 112 and second side portion 114 and first section 120 and second section 122 appear to be mirror components of each other. Bottom support plate 104 further includes a plurality of holes 128*a, b* and *c* that extend entirely through main portion 110 of bottom support plate 104 and will be described in more detail below.

Attached to first side portion 112 of bottom support plate 104 is first wire member 106*a* having a first end 105*a* and a second end 107*a*. Attached to second side portion 114 of bottom support plate 104 is second wire member 106*b* having a first end (not shown) and a second end 107*b*. More specifically, first end 105*a* of first wire member 106*a* is mounted in proximity to a back end of the first side of main portion 110 or of first side portion 112 and second end 107*a* is mounted in proximity to a front end of the first side of main portion 110 or of first side portion 112. Likewise, the first end of second wire member 106 is mounted in proximity to a back end of the second side of main portion 110 or of second side portion 114 and second end 107*b* is mounted in proximity to a front end of the second side of main portion 110 or of second side portion 114.

In one embodiment, each wire member 106*a* and 106*b* is formed of an integral piece of material, such as a piece of metal wire and the like, and has a bend 130*a* and 130*b*, respectively, that defines two legs (i.e., each leg being separated by a bend). A first leg 132*a* of wire member 106*a* is oriented out of alignment from second leg 134*a* of wire member 106*a* by bend 130*a* and a first leg 132*b* of wire member 106*b* is oriented out of alignment from a second leg 134*b* of wire member 106*b* by bend 130*b*. First legs 132*a* and 132*b* are oriented substantially vertically and therefore substantially perpendicular to main portion 110 of bottom support plate 104, which is oriented substantially horizontally. Bends 130*a* and 130*b* orient second legs 134*a* and 134*b* at an acute angle from first legs 132*a* and 132*b*, respectively. For example, at an angle of 36 degrees. Therefore, second legs 134*a* and 134*b* are also positioned at an acute angle relative to main portion 110 of bottom support plate, such as approximately 54 degrees. Together wire members 106*a* and 106*b* with bottom support plate 104 form the main elements of divider 102 for holding and receiving loaded product, such as artwork, mirrors, frames and the like.

Figure 10:
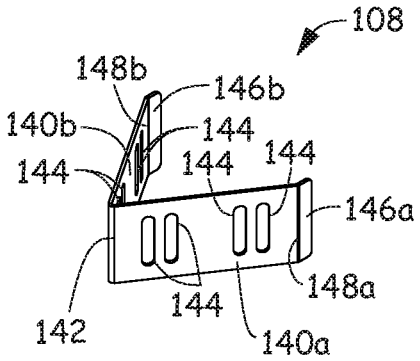
FIG. 10 is a perspective view of the bracket of the divider illustrated in FIG. 6 that mounts the divider to a back wall of a gondola.

As introduced above, divider 102 also includes bracket 108. FIG. 10 illustrates a perspective view of bracket 108 that mounts divider 102 to substantially vertical back walls 202*a* and 202*b* of gondola 200. Bracket 108 is made of a single, continuous piece of metal or the like and includes a first arm 140*a* separated from a second arm 140*b* by a bend 142. Bend 142 provides bracket 108 with an angle 141 (FIG. 8) between first arm 140*a* and second arm 140*b* that is approximately the same as the angle between first section 120 and second section 122 of back edge 118 of bottom support plate. For example, the angle between first arm 140*a* and second arm 140*b* of bracket 108 and the angle between first section 120 and second section 122 of back edge 118 can both be approximately 68 degree. In this way, bracket 108 does not extend outside of the profile of bottom support plate 104.

First and second arms 140*a* and 140*b* of bracket 108 include a plurality of through slots 144. Through slots 144 provide openings for fasteners to be inserted through bracket 108 to mount divider 102 to back wall 202*a* or back wall 202*b* of gondola 200. Bracket 108 further includes a first extension 146*a* defined by a bend 148*a* that extends from an end of first arm 140*a* and a second extension 146*b* defined by a bend 148*b* that extends from an end of second arm 140*b*. As illustrated in FIGS. 5-8, first extension 146*a* attaches, such as by welding, to first leg 132*a* of first wire member 106*a* and second extension 146*b* attaches, such as by welding, to first leg 132*b* of second wire member 106*b*.

With reference back to FIG. 4, FIG. 4 is an enlarged view of a portion of FIG. 1 and details the mounting of divider 102 to a back wall 202*a* or 202*b* of gondola 200. In FIGS. 1-4, the plurality of dividers 102 are each mounted to one of back wall 202*a* or 202*b* of gondola 200 so that at least one of through slots 144 in second arm 140*b* of bracket 108 are aligned with a hole in back wall 202*a* or 202*b* for receiving fasteners. This is clearly shown in FIG. 4 where two of the through slots 144 in second arm 140*b* are aligned with holes in back wall 202*b*.

By mounting second arm 140*b* of bracket 108 to back wall 202*a* or 202*b*, first wire member 106*a* is closer to an aisle defined by gondola 200 than second wire member 106*b* and second side portion 114 of bottom support plate 110 of divider 102 is oriented at an angle 103 (FIG. 2) from back wall 202*a* or 202*b*. Angle 103 is optimal for displaying product where a customer walks through the aisle in the direction indicated by arrow 209. For example, angle 103 can be approximately 34 degrees. However, not all stores are arranged where traffic is mostly traveling in this direction, it may be in other stores that in the aisle where dividers 102 are mounted to display product, foot traffic is more commonly heading in a direction opposite the direction indicated by arrow 209. In this case, dividers 102 can be mounted to back walls 202*a* and 202*b* so that through slots 144 in first arm 140*a* of bracket 108 are aligned with holes in back wall 202*a* or 202*b* for receiving fasteners. By mounting first arm 140*a* of bracket 108 to back wall 202*a* or 202*b*, second wire member 106*b* is closer to the aisle defined by gondola 200 than first wire member 106*a* and first side portion 112 of bottom support plate 104 of divider 102 is oriented at an angle from back wall 202*a* or 202*b* that is optimal for displaying product where a customer walks the aisle in a direction opposite the direction indicated by arrow 209. For example, the angle can be approximately 34 degrees. No matter which of first arm 140*a* or second arm 140*b* is mounted to back wall 202*a* or 202*b*, all dividers 102 on a single shelf are mounted to back walls 202*a* and 202*b* with the same arm so as not to interfere with each other.

As illustrated in FIGS. 1-3, when bracket 108 is mounted to back wall 202*a* or 202*b*, a bottom surface of main portion 110 of bottom support plate 104 is substantially flush or in contact with a top surface of base deck 206 or shelf of gondola 200. In one embodiment, one or more of holes 128*a, b* and *c* can receive fasteners for further securing main portion 110 to base deck 206 or a shelf. When second arm 140*b* of bracket 108 is mounted to back wall 202*a* or 202*b*, as is illustrated in FIGS. 1 and 2, second section 122 of back edge 118 is located adjacent back wall 202*a* or 202*b*. When first arm 140*a* of bracket 108 is mounted to back wall 202*a* or 202*b*, which is not illustrated in the figures, first section 120 of back edge 118 is located adjacent back wall 202*a* or 202*b*.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A display fixture comprising:

a back wall;

a base extending forward from the back wall;

a divider comprising:

a bottom support plate including a main portion having a front edge, a non-linear back edge, a first side and an opposing second side, wherein the non-linear back edge includes a first section that extends backwardly from a back of the first side and intersects with a second section that extends backwardly from a back of the second side at a point;

a first wire member including at least two legs separated by a bend and being mounted to the first side of the main portion;

a second wire member including at least two legs separated by a bend and being mounted to the second side of the main portion; and a bracket that mounts the divider to the back wall and includes a first arm and a second arm separated from the first arm by a bend, the first arm being coupled to and extending from the first wire member and the second arm being coupled to and extending from the second wire member; and wherein the divider is oriented in a first position when the first arm of the bracket and the first section of the non-linear back edge of the bottom support plate are located adjacent to the back wall and is oriented in a second position when the second arm of the bracket and the second section of the non-linear back edge of the bottom support plate are located adjacent to the back wall.

2. The display fixture of claim 1, wherein the first wire member comprises a first end mounted in proximity to a back of the first side of the main portion and a second end mounted in proximity to a front of the first side of the main portion and wherein the second wire member comprises a first end mounted in proximity to a back of the second side of the main portion and a second end mounted in proximity to a front of the second side of the main portion, wherein a first leg of the first wire member and a first leg of the second wire member are oriented substantially vertical relative to the main portion of the bottom support plate that is substantially horizontal and a second leg of the first wire member and a second leg of the second wire member are oriented at an acute angle relative to the main portion of the bottom support plate.

3. The display fixture of claim 1, wherein each of the first arm and the second arm of the bracket have at least one through slot.

4. The display fixture of claim 1, wherein the bracket further comprises a first extension that extends from an end of the first arm and a second extension that extends from an end of the second arm, wherein the first extension is attached to the first wire member and the second extension is attached to the second wire member.

5. The display fixture of claim 1, wherein the first arm of the bracket is in alignment with the first section of the non-linear back edge of the bottom support plate and the second arm of the bracket is in alignment with the second section of the non-linear back edge of the bottom support plate.

6. The display fixture of claim 1, wherein the bottom support plate further includes a first side portion integrally formed with the first side of the main portion and extending substantially vertical relative to the main portion and a second side portion integrally formed with the second side of the main portion and extending substantially vertical relative to the main portion.

7. The display fixture of claim 6, wherein the first and second ends of the first wire member are mounted to the first side portion and the first and second ends of the second wire member are mounted to the second side portion.

8. The display fixture of claim 1, wherein the front edge comprises a linear front edge connecting the first side of the main portion to the second side of the main portion.

9. A display fixture comprising:

a gondola comprising:

a back wall;

a base extending forward from the back wall to a front;

a divider comprising:

a bottom support plate including a main portion having a front edge, a back edge, a first side and an opposing second side, wherein the back edge of the main portion is non-linear and includes a first section that extends backwardly from a back of the first side and intersects with a second section that extends backwardly from a back of the second side at a point;

a first wire member including at least two legs separated by a bend, the first wire member having a first end mounted in proximity to the back of the first side of the main portion and a second end mounted in proximity to a front of the first side of the main portion;

a second wire member including at least two legs separated by a bend, the second wire member having a first end mounted in proximity to the back of the second side of the main portion and a second end mounted in proximity to a front of the second side of the main portion; and a bracket that couples the display fixture divider to the back wall of the gondola, the bracket including a first arm and a second arm separated by a bend, wherein each of the first arm and the second arm have at least one through slot;

wherein when the first arm is mounted to the back wall of the gondola the second wire member faces the front of the base of the gondola and when the second arm is mounted to the back wall of the gondola the first wire member faces the front of the base of the gondola.

10. The display fixture of claim 9, wherein the first arm of the bracket is in alignment with the first section of the non-linear back edge of the bottom support plate and the second arm of the bracket is in alignment with the second section of the non-linear back edge of the bottom support plate.

11. The display fixture of claim 9, wherein the bracket further comprises a first extension that extends from an end of the first arm and a second extension that extends from an end of the second arm, wherein the first extension is attached to the first wire member and the second extension is attached to the second wire member.

12. The display fixture of claim 9, wherein a first leg of the first wire member and a first leg of the second wire member are oriented substantially vertical relative to the main portion of the bottom support plate that is substantially horizontal and a second leg of the first wire member and a second leg of the second wire member are oriented at an acute angle relative to the main portion of the bottom support plate.

13. The display fixture of claim 9, wherein the bottom support plate further includes a first side portion integrally formed with the first side of the main portion and extending substantially vertical relative to the main portion and a second side portion integrally formed with the second side of the main portion and extending substantially vertical relative to the main portion.

14. The display fixture of claim 13, wherein the first and second ends of the first wire member are mounted to the first side portion and the first and second ends of the second wire member are mounted to the second side portion.

15. The display fixture of claim 9, wherein the front edge of the bottom support plate comprises a linear front edge connecting the first side of the main portion to the second side of the main portion.

16. A method of displaying merchandise, the method comprising:

obtaining a divider comprising a bottom support plate having a front edge, a non-linear back edge, a first side and a second side, a first wire member being attached to the first side of the bottom support plate, a second wire member being attached to the second side of the bottom support plate and a bracket having a first arm and a second arm separated from each other by a bend, wherein the non-linear back edge of the main portion includes a first section that extends from a back of the first side and intersects with a second section of the main portion that extends from a back of the second side at a point; and mounting the divider to a back wall of a gondola in one of a first position and a second position based on a direction of foot traffic in an aisle defined by the gondola, wherein in the first position the first section of the non-linear back edge of the bottom support plate abuts the back wall of the gondola and the first arm of the bracket is attached to the back wall and wherein in the second position the second section of the non-linear back edge of the bottom support plate abuts the back wall of the gondola and the second arm of the bracket is attached to the back wall.

17. The method of claim 16, loading the divider with merchandise for display.

18. The method of claim 16, wherein the first section of the back edge is in alignment with the first arm of the bracket and wherein the second section of the back edge is in alignment with the second arm of the bracket.

* * * * *